US005709324A

United States Patent [19]

Peronnet et al.

[11] Patent Number: 5,709,324

[45] Date of Patent: Jan. 20, 1998

[54] MINIATURE DISPENSER

[75] Inventors: Stanislas Peronnet, Paris; Alain Behar, Suresnes, both of France

[73] Assignee: Teleplastics Industries, Parigne L'Eveque, France

[21] Appl. No.: 650,767

[22] Filed: May 20, 1996

[30] Foreign Application Priority Data

May 19, 1995 [FR] France ..... 95 05987

[51] Int. Cl.[6] ..... B65D 88/54

[52] U.S. Cl. ..... 222/321.9; 222/321.1

[58] Field of Search ..... 222/321.1, 321.7, 222/321.9, 383.1, 385

[56] References Cited

U.S. PATENT DOCUMENTS

| | | | |
|---|---|---|---|
| 3,908,870 | 9/1975 | Nozawa et al. | 222/321.7 X |
| 4,017,031 | 4/1977 | Kishi et al. | 222/321.9 X |
| 4,183,449 | 1/1980 | Blake | 222/321.7 |
| 4,462,549 | 7/1984 | Saito et al. | 222/321.9 X |
| 5,102,018 | 4/1992 | Desazars De Montgailhard et al. | 222/321.9 |
| 5,242,089 | 9/1993 | Knickerbocker et al. | 222/321.1 X |
| 5,590,815 | 1/1997 | Montaner et al. | 222/321.7 X |

FOREIGN PATENT DOCUMENTS

| | | |
|---|---|---|
| 0 308 100 | 3/1989 | European Pat. Off. . |
| 0 453 357 | 10/1991 | European Pat. Off. . |
| 1 340 337 | 9/1963 | France . |
| 2 649 382 | 1/1991 | France . |
| 1 482 675 | 7/1969 | Germany . |

*Primary Examiner*—Gregory L. Huson
*Attorney, Agent, or Firm*—Young & Thompson

[57] ABSTRACT

Miniature dispenser (1) comprising a receptacle (2) constituted by a reservoir (3) and a cylindrical neck (4), a cylindrical sleeve (5) carrying a piston pump mechanism having an axial nozzle, the sleeve (5) being engaged within the neck (4) of the receptacle (2), the external periphery of a lower skirt of the sleeve (5) being gripped by cone-on-cone engagement about an internal periphery (4*a*) of the neck (4) of the receptacle (2) and the sleeve (5) comprising, on an external wall (5*b*) thereof, an annular projection (13) bearing on an upper edge of the receptacle (2). The external periphery of a lower skirt of the sleeve (5) and the internal periphery (4*a*) of the neck (4) have snap-in formations (14, 15) that are mutually engagable. An internal wall (5*a*) of the sleeve (5) comprises a peripheral abutment (19) directed toward the interior of the sleeve (5).

5 Claims, 1 Drawing Sheet

MINIATURE DISPENSER

Figure 1:
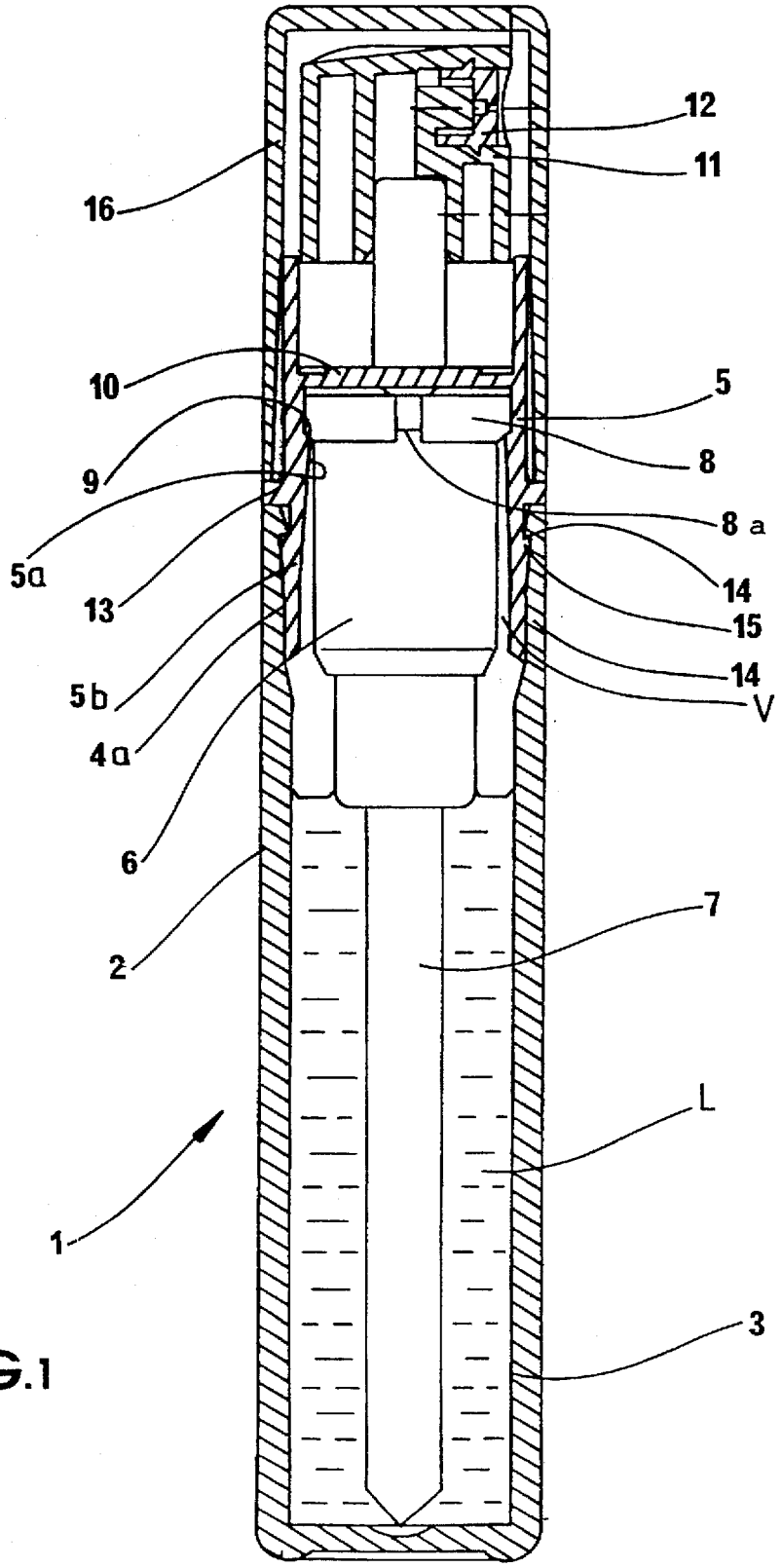

The invention relates to a miniature dispenser adapted in particular for the dispensing of medications in very small doses or perfume samples.

The dimensions required for such a dispenser are principally controlled by the dimensions of the miniature pumps existing on the market. In general, the distributors have most often a capacity that can vary from 50 to 10 doses.

Despite the reduced size of such dispensers, it is desirable to be able to produce them both by mass production and at low production cost.

French patent FR-B-2,649,382 provides a miniature dispenser in which the collar of the pump body abuts against the upper edge of the receptacle, a sleeve covering the pump body by ensleeving the lower skirt of said sleeve on an external abutment of the wall of the receptacle. So as to obtain an object having a satisfactory appearance, the receptacle preferably has an external shoulder in its upper portion, permitting reception of the sleeve which has a cylindrical shape so as to align with the shape of the receptacle.

So as to provide this external shoulder in the upper portion of the receptacle, it is necessary that the wall of said receptacle have a certain thickness such that the thinned wall of the receptacle or the skirt of the sleeve has a sufficient mechanical resistance to support pressure applied in the course of assembly. This requires, as a result, an excess of material used for the receptacle and therefore an increase in the cost of production.

Moreover, in this type of dispenser, the internal volume is completely dependent on the diameter of the pump body to the extent that the latter defines the opening of the neck of the receptacle, the upper neck of the pump body resting on the upper edge of said receptacle.

There is also known from EP-A-0 453 357, a spray dispenser provided with a pump sunk in the neck of a receptacle. Such a device requires forceful sinking of the pump into the neck of the flask which risks damaging the neck and losing the seal.

So as to overcome these drawbacks, it is therefore desirable to provide constituent elements of a miniature dispenser which will be easy to produce and assemble at the lowest cost possible and which will permit dimensioning the internal volume of the receptacle independently of the pump body.

To this end, the invention has for its object a miniature dispenser comprising a receptacle constituted by a reservoir and a cylindrical neck, a cylindrical sleeve comprising a lower skirt and carrying the mechanism of a piston pump bearing an axial nozzle, characterized in that the sleeve is engaged within the neck of the receptacle, the external periphery of the lower skirt of the sleeve being gripped cone-on-cone on the internal periphery of the neck of said receptacle and the sleeve comprises, on its external wall, an annular projection bearing on the upper edge of said receptacle.

Preferably, the seal between the receptacle and the sleeve is as a result insured by cone-on-cone gripping.

According to a preferred characteristic of the invention, the external periphery of the sleeve and the internal periphery of the neck have snap in means interrupting or prolonging the gripping region of cone on cone.

Preferably, the neck of the receptacle corresponds to all the portion of the internal wall of the receptacle against which is gripped the lower skirt of the sleeve.

Also preferably, the wall of the receptacle can be of the same thickness over all the length of said receptacle, which is to say both over the portion of the receptacle corresponding to the reservoir and also at the same time over the portion corresponding to the neck. Preferably, there can be provided, at the level of the neck of the receptacle, a slight thinning increasing from said wall toward the upper edge of the receptacle, such that said neck has a slightly conical internal periphery.

Still further preferably, the pump body is disposed in the middle of the sleeve and has no contact with the receptacle itself. Thus, the dimensions of the sleeve and of the receptacle, so as to provide assembly of the dispenser by cone-on-cone gripping of the external periphery of the lower skirt of the sleeve on the internal periphery of the neck of the receptacle, are independent of the dimensions of the pump body, the collar of the pump body not resting on the upper edge of the receptacle. The diameter of the opening of the receptacle and hence the internal volume of said receptacle do not depend on the dimensions of said collar.

Moreover, the pump body being disposed within the sleeve, there is consequently avoided any risk of damage of the pump body during assembly and in particular by pressure applied to the constituent elements during cone-on-cone gripping.

Preferably, the internal wall of the sleeve comprises at least one peripheral abutment turned inwardly of said sleeve, against which comes into abutment the collar of the pump body during emplacement of the pump within the sleeve.

Because of this, it is possible to cause the thickness of the wall of the sleeve to vary so as to decrease or increase the internal diameter of the sleeve as a function of the dimensions of the pump body which is disposed therein, and this without the need to modify the external diameter of the sleeve and, as a result, the diameter of the opening of the receptacle.

According to one embodiment, the sleeve also comprises on its internal wall, above said peripheral abutment, a transverse partition provided with a central hole for the passage of the pump body and against which comes into abutment the lower edge of a pusher provided for the nozzle, the so-called stem, and permitting actuating the pump.

According to the invention, the receptacle can have a cylindrical outer shape but said shape of the receptacle can also be of any other desired geometrical shape. In the case of a non-cylindrical external contour of the receptacle, only the annular abutment of the sleeve has to have the same shape.

So as to obtain an object having an uninterrupted contour, there can be provided a cap of the same external shape as the receptacle and which is adapted on the push button, resting on the annular projection of the sleeve.

The constituent elements are formed by injection molding of synthetic materials and more particularly thermoplastics such as polyethylene terephthalate, etc.

There will now be described in greater detail an example of embodiment of a miniature dispenser according to the present invention with reference to the accompanying drawing in which the single figure shows a transverse cross section of a miniature dispenser.

A miniature dispenser 1 comprises a receptacle 2 of circular cross section whose lower portion corresponds to the reservoir 3 and the upper portion to the neck 4.

This receptacle 2, obtained by injection molding, has walls that are thinned at the level of the neck 4 such that the internal periphery 4*a* of said neck 4 has a slight conicity.

A sleeve 5 of cylindrical cross section encloses a pump whose body 6 comprises at its lower portion a take-up tube 7 and at its upper portion a collar 8.

The piston pump of the type in question has either at least one bleed 8*a* in said collar 8 or at least one hole in the pump body 6 so as to expose to the air the reservoir 3 so as to maintain it at atmospheric pressure.

The sleeve 5 has on its internal wall 5*a* a peripheral abutment 9 against which comes into abutment the collar 8 of the pump body 6.

The sleeve 5 also has, on its internal wall 5*a*, a transverse partition 10 provided with a central hole permitting passage of the pump body 6 and located above the peripheral abutment 9 such that, when the pump 6 is disposed within the sleeve 5, the collar 8 is located between said partition 10 and said peripheral abutment 9.

A pusher 11 provided with a spray nozzle 12 is disposed on the stem of the pump and, during its actuation, its lower edge comes into abutment against the transverse partition 10.

The sleeve 5 enclosing the pump is mounted on the receptacle 2, the external periphery of the lower skirt 5*b* of the sleeve 5 being gripped cone-against-cone against the internal periphery 4*a* of neck 4 of receptacle 2. The lower skirt 5*b* of the sleeve 5 has a conical external periphery corresponding to the conicity of the internal periphery 4*a* of the neck 4.

The internal periphery 4*a* and the external periphery of the lower skirt 5*b* comprise moreover respective snap-in means 14 and 15.

The sleeve 5 comprises, on its external wall, an annular projection 13 which has an external shape identical to the external shape of the receptacle 2, said annular projection resting on the upper edge of the neck 4 of the receptacle 2.

A cap 16 having an external contour identical to the external contour of the receptacle 2 completes the miniature dispenser 1 thus provided.

During assembly, the pump is first mounted in the middle of the sleeve 5, the collar 8 being disposed below the transverse partition 10 and against the peripheral abutment 9.

The sleeve is then mounted on the neck 4 by cone-on-cone gripping of the external periphery of the lower skirt 5*b* of the sleeve 5 against the internal periphery 4*a* of the neck 4, the reservoir 3 being already filled with liquid L.

The pump being disposed within the sleeve 5, a free volume V is left between the internal wall 5*a* of the sleeve 5 and the body of the pump 6. The sinking of the sleeve 5 can therefore be carried out because the free volume V without the introduction of the body of the pump 6 into the liquid L contained in the reservoir 3 giving rise to a too high internal pressure which could give rise to misshaping of the dispenser 1.

Moreover, the presence of snap-in means 14 and 15 locks the sinking of the sleeve 5 into the neck 4 of the receptacle 2.

Eventually, during the first use of the pump, the exposure of the reservoir 3 to the air permits evacuation of excess air, rendering the internal pressure equivalent to atmospheric pressure.

We claim:

1. Miniature dispenser (1) comprising a receptacle (2) constituted by a reservoir (3) and a cylindrical neck (4), a cylindrical sleeve (5) carrying a piston pump mechanism having an axial nozzle, the sleeve (5) being engaged within the neck (4) of the receptacle (2), the external periphery of a lower skirt of the sleeve (5) being gripped by cone-on-cone engagement about an internal periphery (4*a*) of the neck (4) of said receptacle (2) and the sleeve (5) comprising, on an external wall (5*b*) thereof, an annular projection (13) bearing on an upper edge of said receptacle (2).

2. Miniature dispenser according to claim 1, wherein the external periphery of a lower skirt of the sleeve (5) and the internal periphery (4*a*) of the neck (4) have snap-in means (14, 15) that are mutually engagable.

3. Miniature dispenser according to claim 1, wherein an internal wall (5*a*) of the sleeve (5) comprises a peripheral abutment (19) directed toward the interior of the sleeve (5).

4. Miniature dispenser according to claim 1, wherein the sleeve (5) comprises, on an internal wall (5*a*) thereof, a transverse partition provided with a central hole for passage of the body of a pump (6).

5. Miniature dispenser according to claim 1, which also comprises a cap (16) which fits on the head of a pump disposed within the sleeve and rests on an annular projection (13) of the sleeve (5).

* * * * *